US005337454A

United States Patent [19]

Hergeth

[11] Patent Number: 5,337,454

[45] Date of Patent: Aug. 16, 1994

[54] MILLING MACHINE ON PATHS

[76] Inventor: Hubert A. Hergeth, Königsmühlenweg 1, D-5100 Aachen, Fed. Rep. of Germany

[21] Appl. No.: 730,500

[22] Filed: Jul. 16, 1991

[30] Foreign Application Priority Data

Jul. 17, 1990 [DE] Fed. Rep. of Germany ..... 4022679

[51] Int. Cl.[5] ..... D01G 13/00

[52] U.S. Cl. ..... 19/80 R; 19/81

[58] Field of Search ..... 100/35, 226, 227, 228, 100/210; 19/80 R, 65 A, 65 R, 81

[56] References Cited

U.S. PATENT DOCUMENTS 1,143,918 6/1915 Schuster ..... 366/346
3,531,831 10/1967 VanDoorn et al. ..... 19/81
3,826,188 7/1974 Eberle ..... 100/226
4,363,585 12/1982 Keller et al. ..... 19/80 R
4,747,187 5/1988 Leifeld ..... 19/81
4,996,918 3/1991 Carter et al. ..... 100/226

FOREIGN PATENT DOCUMENTS 0195610 6/1957 Austria ..... 100/226

*Primary Examiner*—Timothy F. Simone
*Assistant Examiner*—Reginald L. Alexander
*Attorney, Agent, or Firm*—Lippe, Goldstein, Wolf, Schissel & Sazer Meltzer

[57] ABSTRACT

Process for the reduction of fiber bales. The fiber bales are set up in several long parallel rows and are reduced by a reducing element travelling along the rows of bales. The reducing element reduces the material in closely adjoining, overlapping paths. The individual offset width may be less than the bale length and several paths can be reduced at the same height level.

10 Claims, 1 Drawing Sheet

MILLING MACHINE ON PATHS

Figure 1:
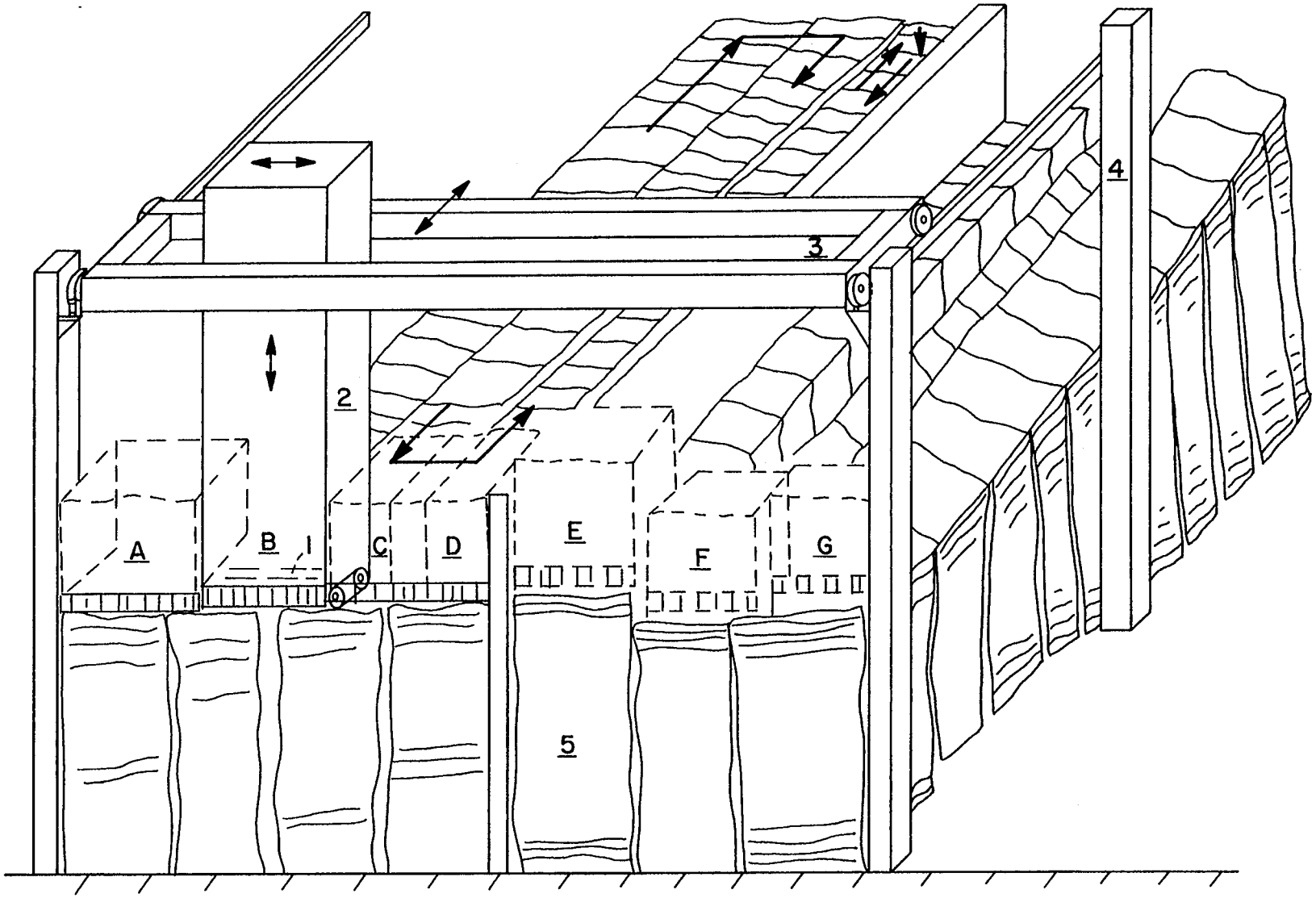

The instant invention relates to a process for the reduction of raw materials such as cotton, for example, pressed into bales. It is customary to reduce bales standing in a row by means of a tower milling machine. The tower travels on rails and a row of bales stands on the left side and another on the right side of the machine. The row of bales may be subdivided. The milling element attached to the tower can be swivelled around the tower to the other bale side. In order to increase the number of presented bales for the same rail length, milling heads of great milling head length, e.g. 1.5 times the bale length have been built. Such bale reduction heads are however of a costlier design and the carriage mechanism is under greater stress.

It is the object of the instant invention to create a new process of bale reduction making it possible to reduce a large number of bales presented continuously while using a small reduction aggregate.

According to the invention the reducing element is carried on a support structure extending over the bales and moving the reducing element so that it continuously removes material from several adjoining bale rows one after the other.

A method by which bale milling devices are suspended from a bridge structure and alternate back and forth between one processing row and a second reserve row is known.

It is the object of the instant application to use such a bridge structure, but instead of allowing the reducing element to assume only 2 positions on the bridge, i.e. one position per row of bales, to allow it to assume several positions per row of bales. The reduction aggregate thus commands more than 2 positions on the transversal path of the bridge. These reduction paths advantageously overlap so as to avoid the formation of residual gaps between the individual reduction paths. Depending on the type of the fiber it is also possible to leave gaps of up to 200 mm between the individual reduction paths. It is also possible to separate several rows of fiber bales by means of intermediate support walls. The reducing element operates between the walls. Several rows of bales can be reduced. The offset shift of the reducing element can also be effected between the walls.

A reduction cycle may be as follows, for example: The milling head starts to remove material on the right outside and travels to the end of the row of bales, shifts laterally at that location by approximately one element width to the left and travels to the beginning of the row of bales while removing material from it. At that point it shifts again to the right and travels to the end of the row of bales. If the row of bales does not extend further to the right the reducing element descends somewhat and again travels to the left by a fraction and then to the end of the row of bales. The bales are reduced in many such processing loops.

FIG. 1 explains the process. A reducing element 1, e.g. a milling roller, is connected via a guide 2 to a bridge structure 3. The guide makes it possible to position the milling element in height and laterally. The height of the reducing element may be adjusted by up to 150 mm over several paths. The bridge structure, supported by pillars, travels along the rows of bales. Rows up to 100 m in length can be set up. Motors or known devices for continuous removal of the reduced material are not shown. The reducing element is in a position B on one of the rows of bales 5. Several rows of bales are separated by a wall 6. The milling device goes to several positions (A-G) and the rows of bales are reduced in these positions.

In FIG. 1, the distance between adjoining paths is less than the width of the bales, so that the reducing paths may overlap to a certain extent (see area between positions C and D).

I claim:

1. A method for continuously reducing material pressed into bales arranged on their ends in a plurality of approximately parallel rows by means of a reducing element, comprising continuously moving said reducing element on top of said bales along closely adjoining, but opposed, paths which are parallel to said rows, and continuously removing said material from said bales by means of said reducing element as it moves along said closely adjoining paths.

2. The method of claim 1 wherein said closely adjoining paths overlap.

3. The method of claim 1 wherein a maximum distance between said closely adjoining paths is no more than 200 nm.

4. The method of claim 1 wherein walls are provided between said rows of bales, and said reducing element is continuously moved between said walls.

5. The process of claim 1 wherein said reducing element is adjustable into several positions along said closely adjoining paths.

6. The method of claim 1 wherein an offset from a first of said closely adjoining paths to a second of said closely adjoining paths is smaller than the width of said bales.

7. The method of claim 1 further comprising adjusting the height of said reducing element as it moves along said closely adjoining paths.

8. The method of claim 7 wherein the height of said reducing element is adjusted by no more than 150 nm.

9. A method for continuously reducing material pressed into bales arranged on their ends in a plurality of approximately parallel rows by means of a reducing element, comprising moving said reducing element on top of said bales along a first path which is approximately parallel to said rows, when said reducing element reaches an end of said first path, moving said reducing element in a direction which is transverse to said first path, moving said reducing element on top of said bales along a second path which is closely adjoining to said first path and which is approximately parallel to said first path but opposite in direction thereto, continuously removing material from said bales by means of said reducing element as it moves along said first and second paths, and continuously repeating said moving and removing steps.

10. The method of claim 9 wherein said first and second paths overlap.

* * * * *